US005651200A

United States Patent [19]

Walsh et al.

[11] Patent Number: 5,651,200

[45] Date of Patent: Jul. 29, 1997

[54] DEBRIS EXCLUSION DEVICES FOR AN AUGERHEAD TYPE HYDRAULIC DREDGE SYSTEM

[75] Inventors: Michael Richard Walsh, Weathersfield, Vt.; Dennis John Lambert, Wilmont Flat, N.H.

[73] Assignee: The United States Corps of Engineers as represented by the Secretary of the Army, Washington, D.C.

[21] Appl. No.: 568,145

[22] Filed: Dec. 6, 1995

[51] Int. Cl.[6] ..... E02F 3/22; E02F 3/94

[52] U.S. Cl. ..... 37/329; 37/318; 37/319

[58] Field of Search ..... 37/318, 317, 319, 37/320, 324, 328, 329, 327

[56] References Cited

U.S. PATENT DOCUMENTS

| | | | |
|---|---|---|---|
| 216,061 | 6/1879 | Shaw | 37/318 |
| 411,183 | 9/1889 | Bowers | 37/319 |
| 903,210 | 11/1908 | Lkievicz | 37/318 |
| 996,237 | 6/1911 | Gridley | 37/318 |
| 1,068,934 | 7/1913 | Sackett | 37/333 |
| 1,169,745 | 1/1916 | Haddon | 37/318 X |
| 1,263,829 | 4/1918 | Wintersgill | 37/318 |
| 2,250,693 | 7/1941 | York et al. | 37/318 |
| 2,819,542 | 1/1958 | Stewart et al. | 37/318 |
| 3,512,280 | 5/1970 | Perna | 37/329 X |
| 3,521,387 | 7/1970 | Degelman | 37/329 X |
| 3,738,029 | 6/1973 | Harmon | 37/318 |
| 3,962,803 | 6/1976 | O'Brien | 37/329 X |
| 4,004,359 | 1/1977 | Klip | 37/319 |
| 4,104,813 | 8/1978 | Lindsey | 37/319 |
| 4,146,982 | 4/1979 | Norisugi | 37/326 X |
| 4,232,903 | 11/1980 | Welling et al. | 37/310 X |
| 4,575,960 | 3/1986 | Deal | 37/329 X |
| 4,628,623 | 12/1986 | Deal | 37/329 X |
| 5,146,699 | 9/1992 | Lipford | 37/319 |

*Primary Examiner*—Terry Lee Melius
*Assistant Examiner*—Thomas A. Beach
*Attorney, Agent, or Firm*—Luther A. Marsh

[57] ABSTRACT

The present invention pertains to debris exclusion devices designed for use on a small augerhead type hydraulic dredge system for operations in debris laden channels that can cause the system's pump to malfunction. Debris to be excluded by these devices include portions of trees, woody-stemmed plants, pieces of lumber, pieces of metal or even unexploded ordinance. A first embodiment comprises vertical grates with curved front surfaces mounted in front of a spoils inlet of a dredgehead shroud with cooperating cutter assembly attached to the auger. These grates are spaced to allow passage of spoils and small debris, but not larger injurious debris that is detrimental to the system's pump. A second embodiment is a tapered transition box device attached to the augerhead's shroud disposed between the grates of a spoils inlet leading through these grates and a hose feeding the system's pump. The box is a clean-out device which is self-regulated and also maintains smooth transitional flow to the system's pump.

13 Claims, 2 Drawing Sheets

DEBRIS EXCLUSION DEVICES FOR AN AUGERHEAD TYPE HYDRAULIC DREDGE SYSTEM

STATEMENT OF GOVERNMENT INTEREST

The invention described herein may be manufactured and used by or for the United States Government for governmental purposes without the payment of any royalties thereon.

FIELD OF THE INVENTION

This invention pertains to an improved augerhead type hydraulic dredge system with debris exclusion devices for prevention of harmful debris ingestion to the system's pump.

BACKGROUND OF THE INVENTION

Small augerhead type hydraulic dredge systems operating in areas containing debris often malfunction due to clogging of the system's pump impeller intake eye. Present dredging systems use screens that are readily clogged; for example, see U.S. Pat. No. 1,705,428 entitled "Dredging Apparatus" by Twiford where a screen is used in the drag arm up-take assembly. Clean-out boxes, similar to the transition box of the instant invention, are not self-cleaning and generally do not allow clean flow of dredge spoils; for example, see York et al.'s U.S. Pat. No. 2,250,693 entitled "Trap for Dredger Suction Pipe."

Other devices used to resolve this problem include rock boxes and macerators; neither of which are appropriate for small augerhead type hydraulic dredge operations. Examples of these features are taught in U.S. Pat. No. 3,738,029 entitled "Dredging Head with Pivotally mounted Mud Shield" by Harmon which shows an augerhead type dredge assembly with dual auger flites as in the instant invention. This teaching is incorporated by reference to show design requirements for a horizontal pair of spiral augers that rotate for digging and moving dredge materials towards a spoils inlet for transfer to the system's slurry or dredge pump.

The instant invention's grate/cutter device and transition box resolve the above mentioned problems. Accordingly, several objects and advantages of the invention herein include providing: i) a cutter/grate device for a small augerhead type hydraulic dredge system with grates that conform with a center arcuate member of augerhead's cutter to prevent ingestion of debris into the system's pump by cutting up vegetation and excluding debris prior to entry into the pump's impeller eye; and ii) a transition box structure behind the augerhead's shroud that has a back-flush and a manual cleanout door. These features as well as others allow efficient dredging operations that are readily apparent to those skilled in the art.

SUMMARY OF THE INVENTION

The present invention pertains to debris exclusion devices for use on a small augerhead type hydraulic dredge system operating in areas containing debris that can cause the system's pump to malfunction. Debris to be excluded by these devices include portions of trees, woody-stemmed plants, pieces of lumber, pieces of metal or even unexploded ordnance. A first embodiment comprises vertical grates with curved front surfaces mounted in front of a spoils inlet of a dredgehead shroud with cooperating cutter assembly attached to the auger wherein the auger includes stiff tines along flites of the auger diametrically disposed opposite the cutter thereby premacerating the dredged material before entering the spoils inlet. These grates are spaced to allow passage of spoils and small debris, but not larger injurious debris that is detrimental to the system's pump. A second embodiment is a tapered transition box device attached to the augerhead's shroud disposed between the grates of the spoils inlet leading through these grates and a hose feeding the system's pump. The box is a clean-out device that is self-regulating. For a further understanding of the invention, and further objects, features and advantages thereof, reference may now be had to the following description with accompanying drawings.

DETAILED DESCRIPTION

Figure 1:
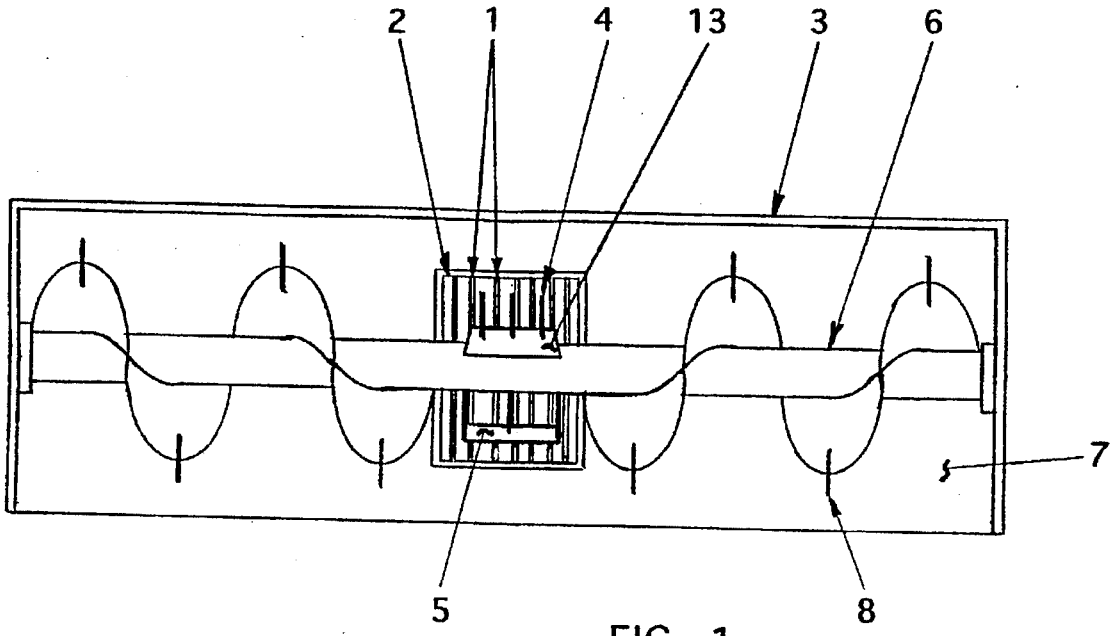
FIG. 1 shows a frontal view of the augerhead assembly.
Figure 2:
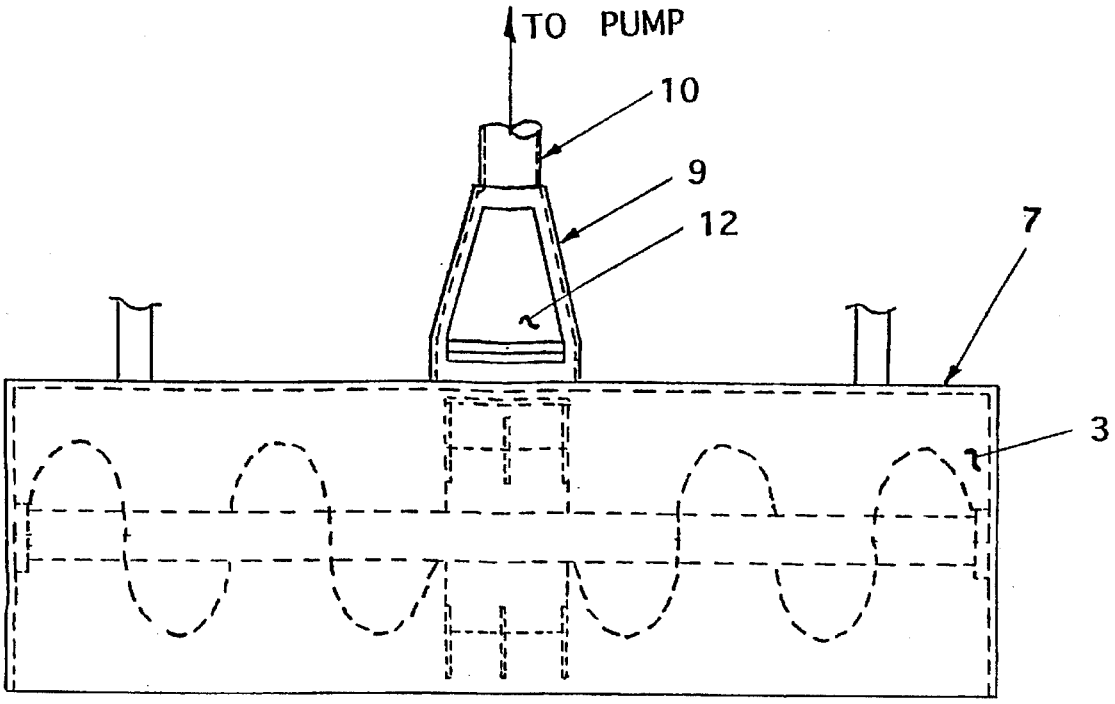
FIG. 2 shows a top view of the augerhead assembly.
Figure 3:
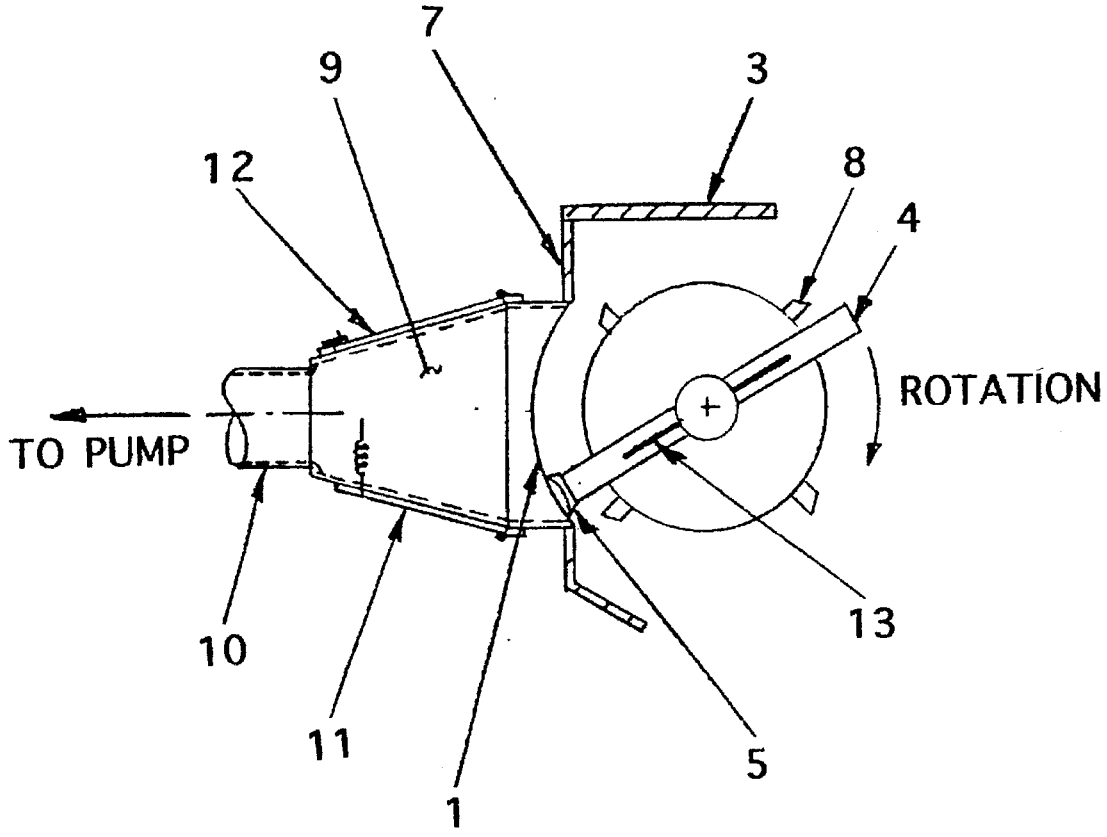
FIG. 3 shows a cross-sectional view of the augerhead assembly.
Figure 4:
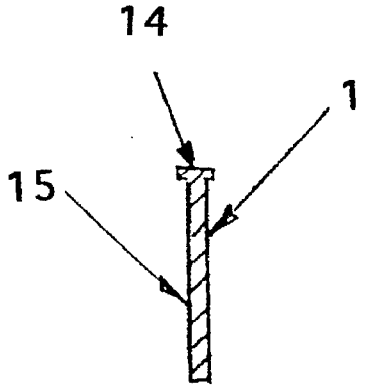
FIG. 4 shows special reliefs behind a grate face.

As shown in FIGS. 1–4, the debris exclusion devices of the instant invention are intended for small augerhead type hydraulic dredges operating in areas containing debris as mentioned above that would cause malfunctioning of the dredge system's pump.

A first embodiment of the invention comprises vertical grates 1 with curved front surfaces mounted in front of a spoils inlet 2 of a dredgehead shroud 3. These grates 1 are spaced to allow passage of spoils and small debris, but not larger more injurious debris. The debris is swept by a toothed 16 or non-toothed cutter 5 attached to paddles 13 on the center section of the auger 6. The center of the inlet 2 and the centerline of the auger 6 are in the same plane. The cutter 5 sweeps large debris excluded by the grates 1 from the front of the grates 1, thus preventing blockage of the inlet 2. It also cuts any vegetation that may be entangled in the grates 1. The arc of the rotating cutter 5 matches that of the grates 1, and the grates 1 are set into the face of the augerhead shroud 7. Special reliefs 15 behind the front surface 14 of the grates 1 reduce the incidence of debris slightly larger than the grate's openings jamming between the grates. Optional sharpened tines 8 assist in chopping any vegetation before feeding this material into the spoils inlet 2. The cutter 5 is double-edged to dislodge debris from the grates. Deflector bars 4 ejects larger debris and macerates vegetation.

A second embodiment of the invention is a tapered transition box 9 behind the grates 1 that allows for smooth transitional flow through the grates 1 to hose 10 feeding the system's pump. A hinged lockable clean-out 12 is located on the top of the transition box to allow inspection access to and manual cleaning of the back of grates 1. A spring loaded backflush door 11 is located at the bottom of the transition box 9 for allowing any problematic debris to exit automatically the system during a line backflush operation. A flow-restricting trap door 20 may be incorporated for positively redirecting backflow through the backflush door 11.

Although the description above contains many specificities, these should not be construed as limiting the scope of this invention as set forth in the appended claims, but as merely providing illustration of the presently preferred embodiment of this invention. For example either of the transition box or cutter/grate configuration can be independently used in other material transfer systems or even other types of hydraulic dredge systems.

We claim:

1. In a dredging device of the type comprising augering means for dredging rotatably enclosed in an auger shroud having transversely spaced end walls, a substantially closed rear wall, and an open front face, the augering means extends beyond a spoils inlet and is constructed and arranged to deliver dredged material to the spoils inlet at a central section of the auger shroud, and a transferring means with a converging hydrodynamic contour for conveying the dredged material delivered thereto by the augering means to a location remote from the device, the transferring means hydraulically communicates with i) the shroud's central section at the spoils inlet and ii) a pumping and piping means, further in combination with:

multiple vertical grate members forming a grating, the grating is mounted in front of the shroud's spoils inlet;

each grate member: i) is spaced apart from each other forming openings that allows passage of dredged material with non-injurious debris, ii) has a "T" cross-sectional form with a relief section, the relief section forming the widest opening space between each grate member and iii) has a concave outer face juxtaposed to the augering means, thereby minimizing debris jamming between each grate member caused by debris that is larger than the widest opening space;

whereby the transferring, piping and pumping means are not adversely affected during operation.

2. The device of claim 1 wherein the central section of the augering means juxtaposed to the spoils inlet includes:

at least one pair of radial members that are: i) are attached and extend from an axial hub member of the augering means and ii) arcuately spaced from the grating and extend beyond the auger shroud;

at least one plate-type paddle member that:

a) radially extends with respect to an axial aspect of the augering means, the at least one paddle member's height is less than the radius defined by the axial aspect of the augering means and b) is attached: i) in a substantial axial direction along the axial hub member and ii) between the at least one pair of radial members;

whereby the dredged material is agitated and dislodged at each grate member's concave outer face.

3. The device of claim 2 wherein the at least one pair of radial members further includes an elongated cutter member that: i) extends between the ends of the at least one pair of radial members and whose outer face is aligned to freely move in proximity to the grating during augering means operation, whereby sweeping and macerating actions occur that minimize jamming and blockage of the spoils inlet.

4. The device of claim 2 wherein the at least one pair of radial members are deflector bars for dislodging debris from the grating.

5. The device of claim 3 wherein the cutter member is non-toothed.

6. The device of claim 3 wherein the cutter member is double-edged.

7. The device of claim 3 wherein the cutter member is toothed.

8. The device of claim 1 wherein the augering means includes sharpened tines attached to flites of the augering means that are diametrically disposed opposite to the cutter member, whereby the dredged material is premacerated prior to conveyance to the central section of the augering means.

9. The device of claim 1 wherein the augering means is a pair of spaced and digging-and-conveying screw augers mounted on a shaft and extending: i) horizontally and transversely of a forward dredging directional operation and ii) outwardly from the spoils inlet.

10. The device of claim 1 wherein the transferring means is a tapered transition box, the transition box includes:

a hinged, lockable and outward opening clean-out port that is located on the box's top side thereby allowing inspection access to the grating's back side; and a hinged, spring loaded, outward opening backflush port that is located on the box's bottom side;

whereby the backflush port's unhinged side opens and is tensioned by the spring during a hydraulic backflush operation allowing problematic debris to automatically exit from the transition box..

11. The device of claim 10 wherein the transition box further includes a flow-restricting trap door for positively redirecting backflow through the backflush port.

12. In a dredging device of the type including augering means for dredging rotatably enclosed in an auger shroud having transversely spaced end walls, a substantially closed rear wall, and an open front face, the augering means being constructed and arranged to deliver dredged material to a spoils inlet at a central section of the auger shroud, and a transferring means with a converging hydrodynamic contour for conveying the dredged material delivered thereto by the augering means to a location remote from the device, the transferring means hydraulically communicates with i) the shroud's central section at the spoils inlet and ii) a pumping-and-piping means further, in combination with:

the transferring means is a tapered transition box attached to the pumping-and-piping means, the transition box includes:

a hinged, lockable and outward opening clean-out port that is located on the box's top side thereby allowing inspection access to the grating's back side; and a hinged, spring loaded, outward opening backflush port that is located on the box's bottom side;

whereby the backflush port's unhinged side opens and is tensioned by the spring during a hydraulic backflush operation allowing problematic debris to automatically exit from the transition box.

13. The device of claim 12 wherein the transition box further includes a flow-restricting trap door for positively redirecting backflow through the backflush port.

* * * * *